US011835231B2

(12) United States Patent
VanNatta

(10) Patent No.: US 11,835,231 B2
(45) Date of Patent: Dec. 5, 2023

(54) THERMOGENIC VORTEX COMBUSTOR

(71) Applicant: James Brent VanNatta, Shelbyville, IN (US)

(72) Inventor: James Brent VanNatta, Shelbyville, IN (US)

( * ) Notice: Subject to any disclaimer, the term of this patent is extended or adjusted under 35 U.S.C. 154(b) by 91 days.

(21) Appl. No.: 15/932,179

(22) Filed: Feb. 16, 2018

(65) Prior Publication Data

US 2020/0056785 A1 Feb. 20, 2020
US 2022/0221148 A9 Jul. 14, 2022

Related U.S. Application Data

(63) Continuation of application No. 14/120,069, filed on Apr. 22, 2014, now abandoned.

(60) Provisional application No. 62/600,485, filed on Feb. 22, 2017.

(51) Int. Cl.

*F23G 5/32* (2006.01)
*F23G 5/24* (2006.01)
*F23G 5/44* (2006.01)

(52) U.S. Cl.

CPC ..... *F23G 5/32* (2013.01); *F23G 5/24* (2013.01); *F23G 5/44* (2013.01); *F23G 2200/00* (2013.01); *F23G 2203/30* (2013.01); *F23G 2206/10* (2013.01); *F23G 2207/30* (2013.01); *F23G 2900/50214* (2013.01)

(58) Field of Classification Search

CPC ..... F23G 5/32
See application file for complete search history.

(56) References Cited

U.S. PATENT DOCUMENTS 2,452,517 A * 10/1948 Broughton ..... C01B 17/58 159/4.07
2008/0014537 A1* 1/2008 Atreya ..... F23G 7/065 431/5
2016/0033127 A1* 2/2016 VanNatta ..... F23L 1/00 110/244

FOREIGN PATENT DOCUMENTS

GB 112155 * 12/1917

* cited by examiner

*Primary Examiner* — Jason Lau
(74) *Attorney, Agent, or Firm* — Woodard, Emhard, Henry, Reeves & Wagner, LLP

(57) ABSTRACT

A combustor for burning waste material includes a horizontally extended combustion chamber through which a mixture of waste material and air is introduced under pressure tangentially for establishing a vortical movement of the waste material, and is ignited during its vortical movement. A second discharge port extends for discharging from the chamber non-combustible waste material, to a separator which separates the discharged gases and solid material. A secondary air manifold supplies air through controlled dampers at portals positioned at intervals along the length of the chamber. An adjustable baffle is mounted internally on the flue adjacent its open end for deflecting outwardly toward the side wall any combustible material not yet destroyed. A recuperator is mounted externally to the chamber on the exhaust flue, supplying heated air used with primary air flow. Additionally, control means are provided for the use of sensors to monitor the chamber conditions.

14 Claims, 9 Drawing Sheets

INVENTOR
JAMES B. VAN NATTA

INVENTOR
JAMES B. VAN NATTA

INVENTOR
JAMES B. VAN NATTA

INVENTOR
JAMES B. VAN NATTA

INVENTOR
JAMES B. VAN NATTA

INVENTOR
JAMES B. VAN NATTA

INVENTOR
JAMES B. VAN HATTA

THERMOGENIC VORTEX COMBUSTOR

CROSS-REFERENCE TO RELATED APPLICATIONS

Certain features disclosed in this application are disclosed and claimed in U.S. Pat. No. 3,577,940 issued on May 11, 1971 to Robert J. Hasselbring and Robert L. Shields, and U.S. Pat. No. 3,727,563 issued on Apr. 17, 1973 to Robert J. Hasselbring and Robert L. Shields, and U.S. Pat. No. 3,568,017 issued on Apr. 25, 1972 to Norman R. Dibelius and William L. Zabriskie.

BACKGROUND OF THE INVENTION

1. Field of the Invention

This invention relates to combustors and has particular relation to industrial and municipal-type combustors for burning waste material, mobile combustors for first response disaster cleanup, and combustors using agricultural waste, coal, and tires as alternative fuels.

2. Description of the Prior Art

Conventional industrial and municipal type combustors ordinarily include one or more combustion chambers having drying grates with a flue for discharging to atmosphere the gaseous products of combustion of waste material in the chambers. Depending upon the efficiency of a particular combustor design varying amounts of noxious gases and ash are discharged through the flue to atmosphere. Prior combustor designs in general have been incapable of effecting good combustion of waste material such that the products of the resulting incomplete combustion consist of a large quantity of noxious gases and ash which are discharged to the surrounding atmosphere in the form of dense acrid smoke.

In an effort to comply with regulatory air pollution codes, more recent combustor designs have provided for cleaning the gaseous products of combustion prior to their discharge to atmosphere. Such flue gas cleaning apparatus is usually of costly and bulky construction and in some cases has not operated to clean the flue gases sufficiently to comply with the regulatory codes. One known flue gas cleaning apparatus includes means for conducting the gaseous products of combustion through water sprays so that the suspended ashes and other particulate matter are entrained in the water which is then collected and conveyed to a suitable clarification system. This type of flue gas cleaning apparatus is expensive and complex and contributes not only to the high cost and massive structure of prior art combustors, but also to water pollution. Further, the very high temperatures within the chambers necessary to effect good combustion result in very hot flue gases which may result in inefficient operation of the flue gas cleaning apparatus and resulting undesirable pollution of the surrounding atmosphere. The provision of flue gas cleaning apparatus thus imposes a limitation upon the temperature within the combustion chambers which contributes to the poor combustion realized by certain prior art designs.

It is necessary of course that provision be made for collecting and disposing of any non-combustible material. One known apparatus for accomplishing this function comprises a conveyor disposed beneath the combustion chambers for receiving such material and for conveying the same from the combustion chambers to a suitable disposition area.

Such conveying apparatus is also very costly and in addition, occupies considerable space which further contributes to the high cost and massive structure of prior art combustors.

OBJECTS OF THE INVENTION

It is therefore a primary object of the invention to provide a novel and improved combustor capable of effecting substantially complete combustion of waste material and wherein essentially solid-free flue gases are discharged to the atmosphere to minimize air and water pollution.

It is another object of the invention to provide a novel and improved combustor of such character which avoids the use of costly and complex flue gas cleaning apparatus.

It is a further object of the invention to provide a novel and improved vortex combustor of the foregoing character wherein non-combustible material is discharged from the combustion chamber during the burning process by action of the vortex without the use of costly and bulky material handling and conveying apparatus.

It is a still further object of the invention to provide a novel and improved vortex combustor of the foregoing character wherein the burning process is more efficiently carried on and the removal of fly ash, as well as the discharge of non-combustible material are facilitated.

SUMMARY OF THE INVENTION

In carrying out the invention in one preferred form, a combustor is provided which includes a combustion chamber having spaced end walls and a side wall with its central longitudinal axis extending between the end walls. The chamber is preferably disposed in operative position with its central longitudinal axis extending horizontally or substantially horizontally. Means are provided for introducing a mixture of waste material and primary air into the chamber tangentially to the sidewall for establishing a vortical movement of the waste material toward one of the end walls and provision is made for igniting the waste material during its vortical movement.

Secondary air is introduced into the chamber substantially tangentially to the side wall at a plurality of regions which are spaced substantially throughout the entire length of the chamber and which are aligned along a horizontal axis. These regions are located adjacent the bottom of the chamber at one side thereof such that secondary air is introduced in directions to maintain the vortical movement of waste material. The secondary air entering the chamber at each of the mentioned spaced regions is controlled by an independently controllable damper which can be adjusted automatically and manually to control the amount of air entering the chamber and contributing to the vortex energy at each region. The secondary air is supplied through a blower-feed manifold and automatically controllable dampers control generally the secondary air distributed through the manifold. The automatic dampers are controlled adjustably and operate automatically in response to temperature variations in the chamber.

A discharge flue port has an open end opening in the chamber near the one end wall and substantially concentric with the central longitudinal axis of the chamber. Means are provided external to the chamber and this discharge flue, in which a recuperator is attached in such a way as to return air flow heated with the superheated exhaust gases for use in the intake means that provides the mixture of waste material and primary air. This recuperator provides necessary heated air flows to those portions of the process that benefit from the heated air, such as drying the shredded waste material prior to entering the chamber and creating a more efficient primary air flow.

A second discharge port includes an open end opening in the chamber adjacent to the inner surface of the side wall for discharging from the chamber during the burning process non-combustible material entrained in the outer region of the vortex. The open end of the second discharge port is located adjacent the bottom of the chamber at the side thereof substantially opposite one of the regions of introduction of the secondary air. The material discharged by the second port is conveyed through a conduit to a separator which separates the gases and the solid material and means are provide to introduce the separated gases and any solid particles suspended therein back into the combustion chamber.

The burning waste material moves in the vortical path from the entry point substantially near the front end wall, towards the back end wall, in a free vortex with means provided by use of an adjustable baffle that increase the residence time and allow for the waste material to be entrained back into the outer region of the vortex for continuous burning until complete combustion has been achieved. This baffle enhances the deflection of these residual combustible materials, with adjustments allowed for various fuel sources and conditions.

Means are further provided to integrate the various components of the invention, to ensure proper and efficient control and management of the entire operational process. These means include a combination of a computer and programmable controls, with applicable software and preset conditions, and with the capability of being connected to popular network interface protocols. This network interfacing will allow for real-time data transmission, as well as remote access of the various operational controls.

DESCRIPTION OF A PREFERRED EMBODIMENT

Figure 1:
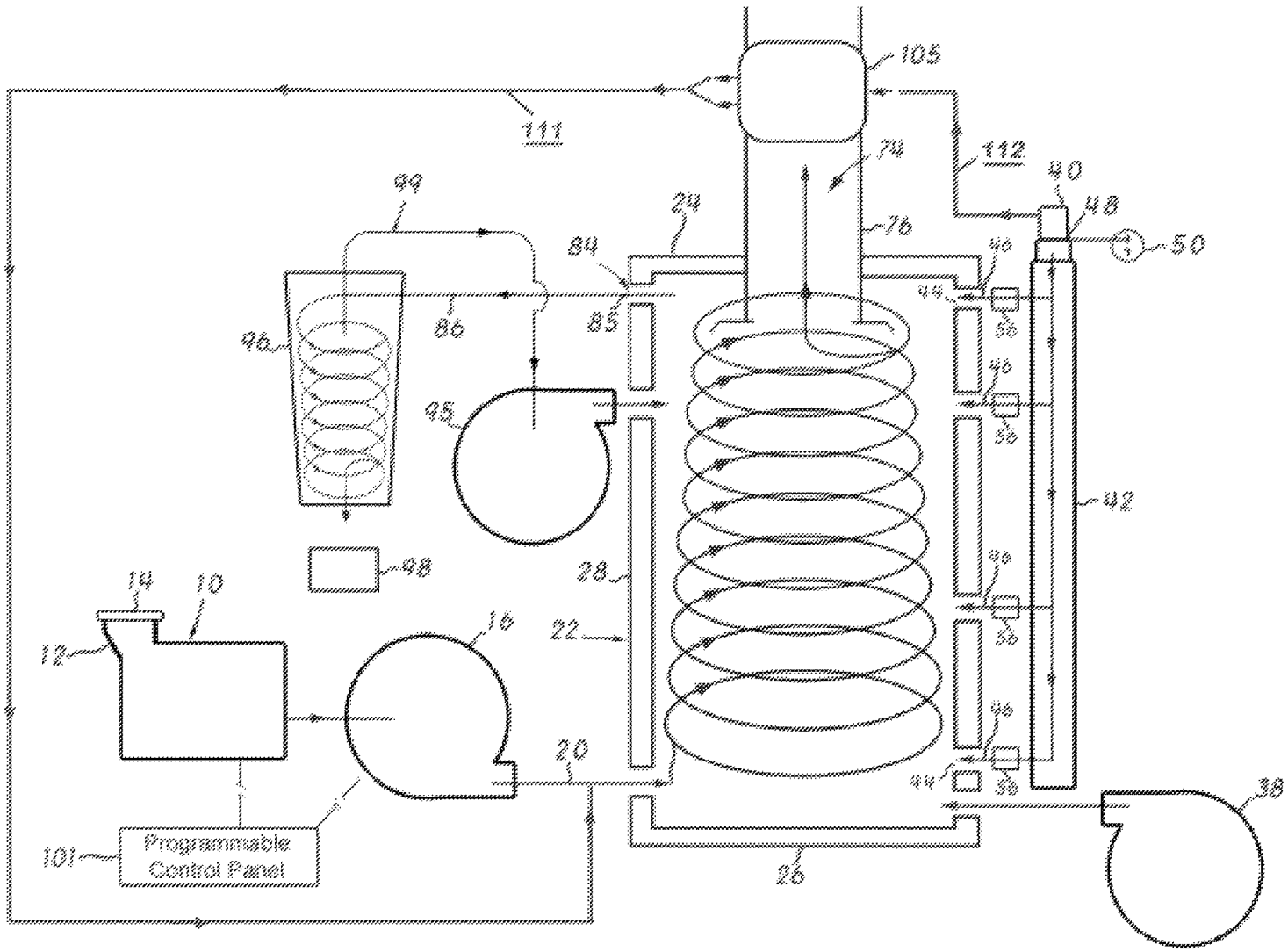
FIG. 1 is a schematic diagram of a combustor embodying the invention showing in particular the path of vortical movement of the waste material within the combustion chamber, the method of controlling non-combustibles, the distribution paths of secondary air, the inclusion of automation controls, and the location of the recuperator.

Referring now to the drawings, there is illustrated in FIGS. 1-9 a combustor embodying the invention and comprising in general a size reduction unit for chopping up the waste material, means for introducing the waste material and primary air into a combustion chamber for establishing a vortical movement of the waste material, means for igniting the waste material during its vortical movement, means for introducing secondary air into the chamber, discharge means for discharging gaseous products of combustion, and non-combustible material from the combustion chamber, a separator for separating the gaseous and solid material discharged by the discharge means, and a recuperator to provide heated air to the primary air/waste feed intake. The combustor of the present invention is particularly suited for disposing of solid industrial and municipal waste materials, including but not limited to standard waste, such as for example, paper, peanut hulls, cardboard cartons, wood scrap, garbage, foliage, woody biomass, plastic items and more. However, the combustor is also capable of disposing of liquid waste material such as oils, paint sludges and plating tank residue.

Figure 5:
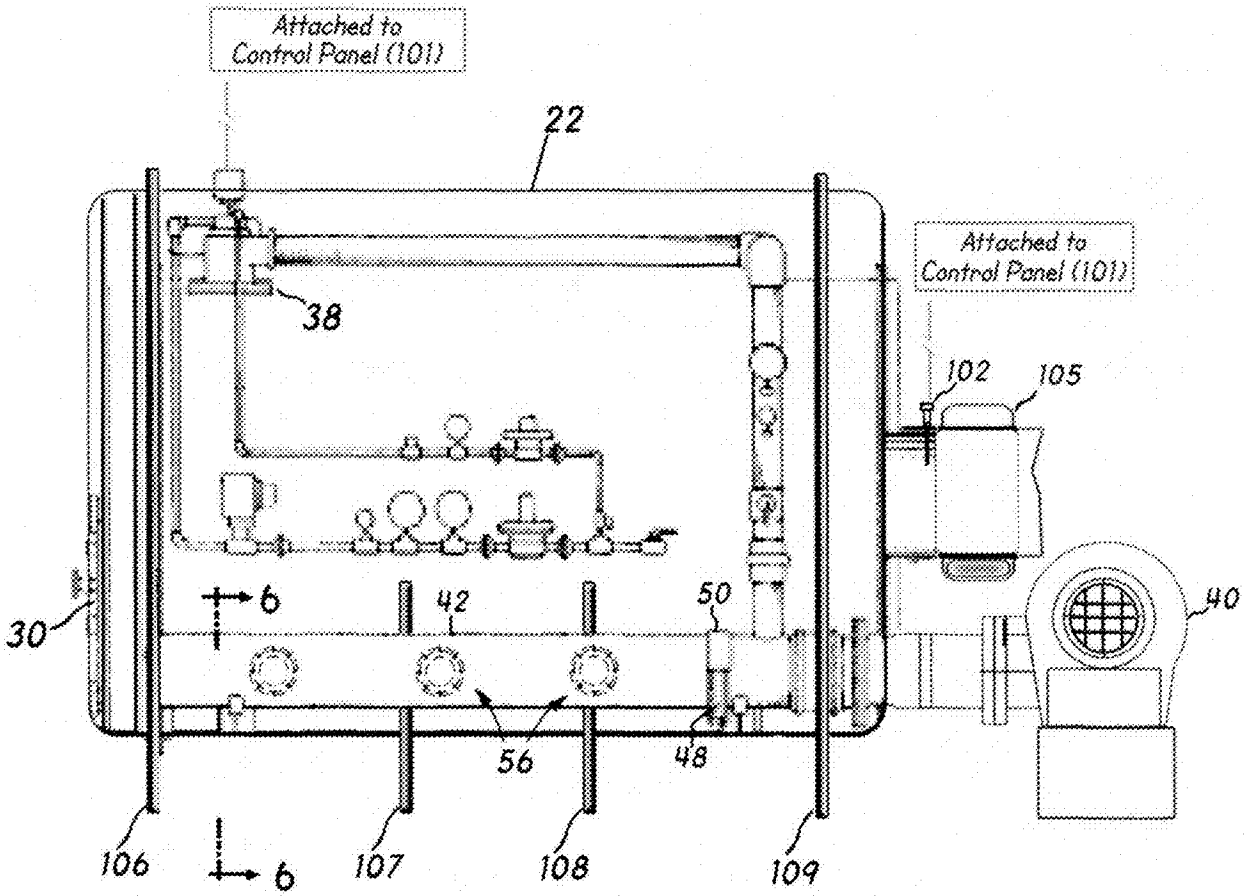
FIG. 5 is a view in side elevation of the combustion chamber and the secondary air manifold and recuperator associated therewith.

More specifically, the combustor as schematically shown in FIG. 1 includes a size reduction unit 10 designed to shred and chop the waste material into pieces small enough to be efficiently conveyed to and burned in the combustion chamber. If the waste material to be disposed of is already of an acceptable size, such as sawdust, then the size reduction unit 10 is not required. The size reduction unit 10 may be of any suitable construction and includes a hopper 12 having an open end 14 into which the waste material is fed for size reduction by a shredding and chopping mechanism (not shown) operated by a motor (not shown). After being reduced in size, the waste material is drawn into a pneumatic conveying system including a commercially available blower 16 operated by a motor (not shown) which entrains the size reduced material in a primary air stream and transports it through a pipe 20 which opens into a combustion chamber 22. The size reduction unit 10 and blower 16 are connected to a programmable control panel 101, the purpose being to control the operation of said size reduction unit 10 and primary air blower 16, described hereinafter. The combustion chamber 22 may be of any suitable configuration and is preferably cylindrical including a pair of spaced end walls 24 and 26 connected by an annular side wall 28. The chamber 22 is preferably disposed when in operative position so that its central longitudinal axis which extends between the end walls 24 and 26 is horizontal or substantially horizontal as shown in FIGS. 3 and 5. Saddles are used for overall chamber stability, with a front full saddle 106, two mid positioned half saddles, 107 and 108, and a rear full saddle 109. The front saddle 106 is positioned at the intersection of the front end wall 26 with the annular side wall 28, and the rear saddle 109 is positioned at the intersection of the rear end wall 26 with the annular side wall 28. If desired, the end wall 24 of the chamber 22 may include an access door 30 to permit access to the interior of the chamber 22. A specially tempered site glass 31 offers visual access through the door 30, allowing the operator to look into the chamber without the need to open the access door 30. If also desired, end walls 24 and 26 can be adjustably releasable to facilitate easier maintenance of the chamber 22. In the specific embodiment of the invention illustrated, the side wall 28 of the chamber 22 comprises an outer casing 32 (FIG. 3) formed of any suitable material such as low carbon steel and the casing 32 is lined with one or more inner layers 34/35/36 of any suitable refractory material such as fire brick. The innermost layer 34 of any suitable material such as high density refractory material is designed to exhibit good resistance to abrasion and impact and capable of extremely high temperatures, whereas the layer 35 may be designed to have good heat insulating qualities or to transfer the heat to a remote location, such as insulating firebrick, capable of withstanding temperatures above 2,300° F. A thin layer of refractory material 36 that offers very good insulating properties (often referred to as "paper") is layered between the insulating firebrick 35 and the outer casing 32. The desired thicknesses of these refractory layers depends on the amount of reduction in temperature so that the outer casing temperature meets current OSHA standards, namely to remain at or below 150° F. while the combustor is in operation. In the embodiment illustrated, the pipe 20 enters the chamber 22 tangentially of the side wall 28 near the top of the chamber 22 adjacent the end wall 26 and at the left side of the chamber as viewed in FIG. 2. In certain installations it may be desirable to have the pipe 20 enter the chamber 22 at a region which is substantially midway between the end walls 24 and 26.

Figure 6:
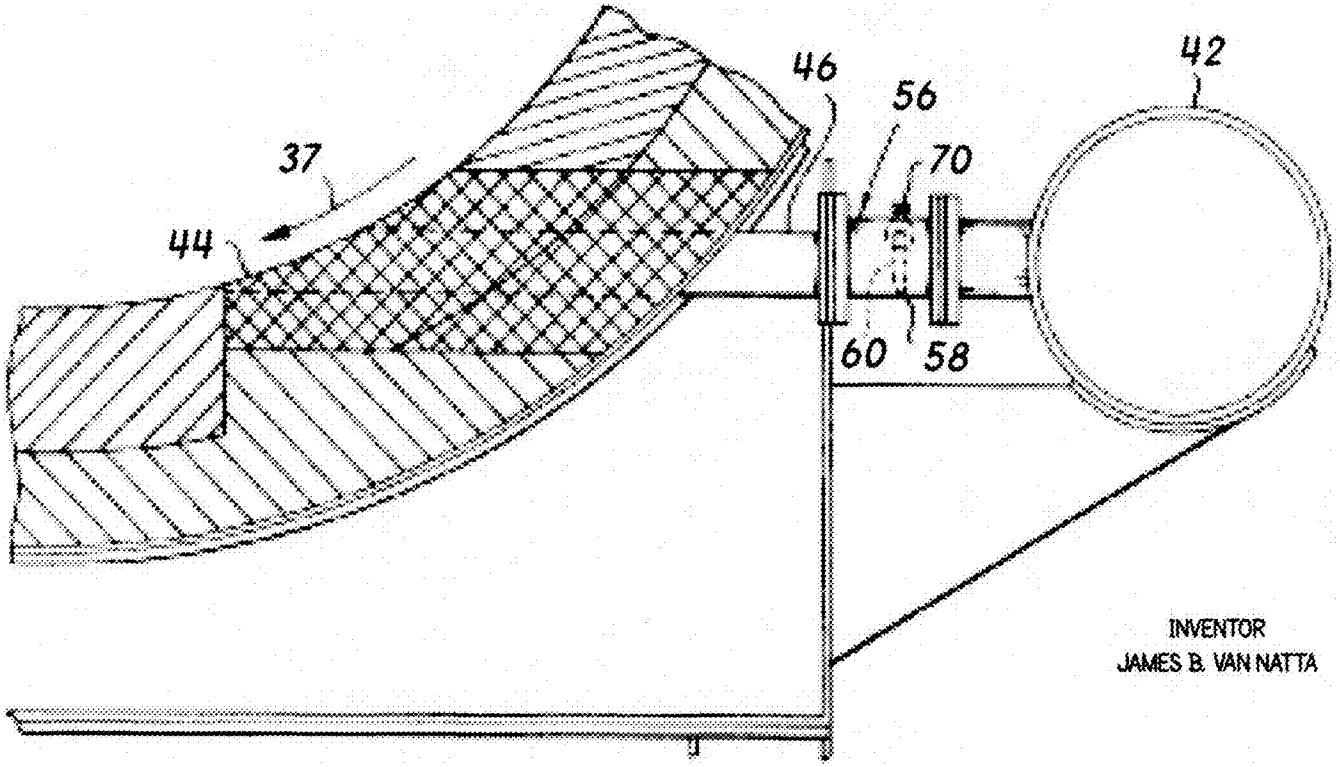
FIG. 6 is a view in section taken along the line 6-6 of FIG. 5.

Continuous injection of a mixture of size-reduced waste material and air into the chamber 22 from the pipe 20 tangentially to the side wall 28 establishes a vortical flow of the waste material which travels from adjacent the end wall 26 toward the end wall 24 in a clockwise direction as viewed from the end wall 26 in FIG. 1 or in the direction of the arrow 37 in FIG. 6. It is understood of course that the pipe 20 may be disposed to enter the chamber 22 at the upper right hand side thereof instead of the upper left hand side in which event the direction of the vortex would be reversed from the clockwise direction illustrated to a counterclockwise direction.

The total pressure of the air exiting from the pipe 20 can be as high as 20 inches $H_2O$ and is preferably about 12 inches $H_2O$. However, such pressure can be as low as 4 inches $H_2O$ when burning finely divided, highly combustible material at a lower heat release rate. Therefore, pressures of air exiting from the pipe 20 are generally within the range of 4 inches $H_2O$ to 20 inches $H_2O$.

Figure 2:
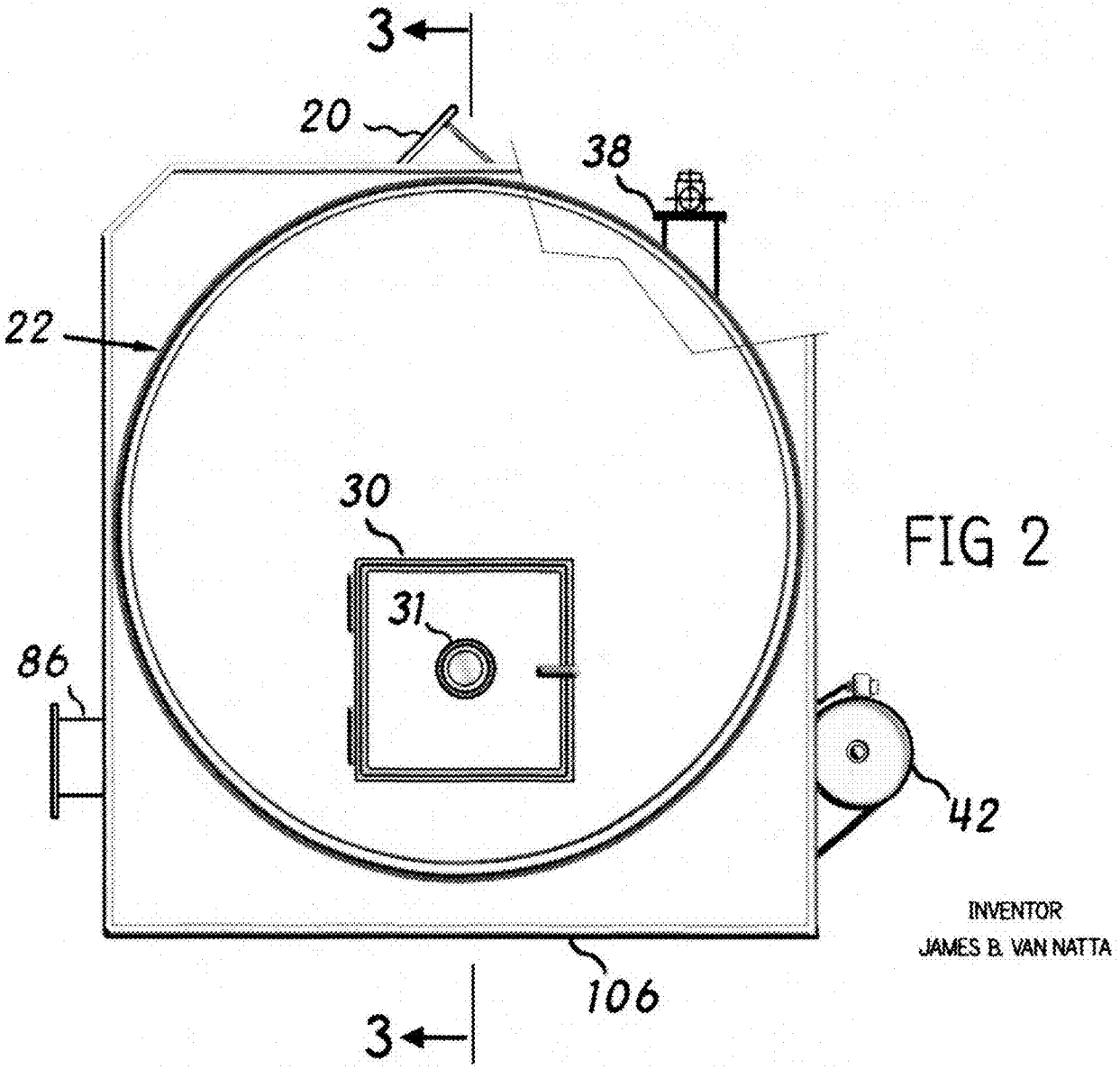
FIG. 2 is a view in end elevation of the combustion chamber.
Figure 3:
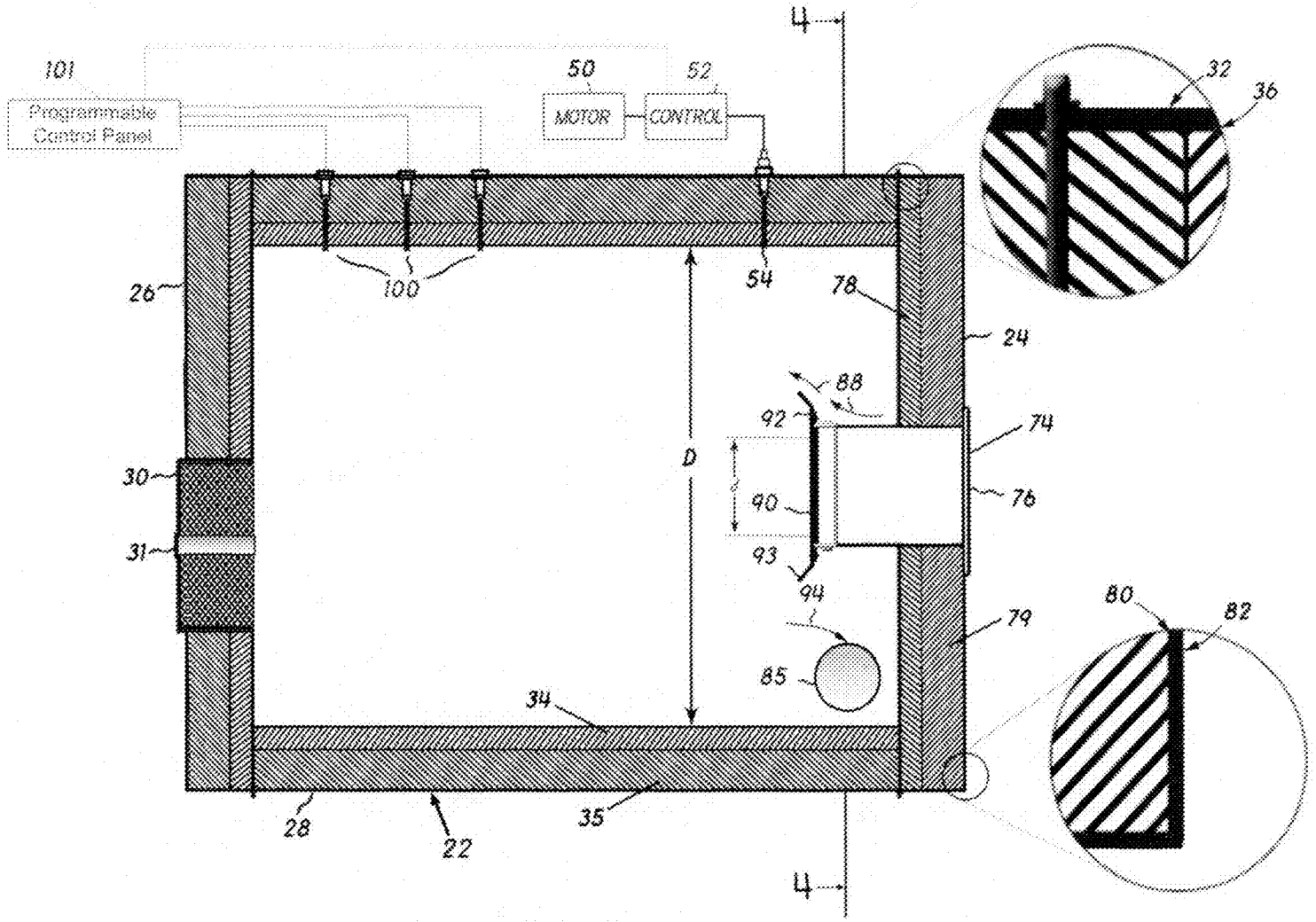
FIG. 3 is a view in section taken along the line 3-3 of FIG. 2 and including a schematic illustration of the automatic secondary air control means.

In order to ignite the waste material entering the chamber 22, a suitable commercially available burner 38 is disposed near the end wall 26 of the chamber 22 to fire tangentially into the chamber adjacent the top and at the right side thereof as viewed in FIG. 2. The burner 38 can be fueled with natural gas or propane gas for remote applications. Under conditions wherein a mixture of waste material and air is continuously fed into the chamber 22, it has been observed that the burner 38 may ordinarily be turned off after ignition of the waste material is accomplished.

In order to enhance combustion of the waste material and to maintain the energy of its vortical flow in a predetermined and controlled manner through the entire length of the combustion chamber, provision is made for introducing controlled quantities of high velocity secondary air into the chamber 22 during the burning process and at spaced regions throughout the length of the chamber. To this end, a commercially available, motor-driven fan or blower 40 is disposed to introduce secondary air into an elongated manifold 42 suitably supported externally of the chamber and extending along an axis substantially parallel to the longitudinal axis of the chamber. Also the manifold 42 is located preferably near the bottom and at the right side of the chamber as viewed in FIG. 2. The secondary air is injected substantially tangentially into the chamber through a plurality of substantially equally spaced openings 44 in the side wall 28 and at regions located downstream of the region of introduction of the mixture of primary air and waste material. In a preferred embodiment, the openings are provided along the entire length of the chamber and are four in number. Additionally, and as illustrated in FIG. 6, the tangential injection of the secondary air into the chamber is provided by means of conduits 46 extending between the manifold 42 and the bottom portion of the chamber. If desired, means (not shown) may be provided for preheating the secondary air which is introduced into the chamber 22 through the openings 44 by means of the fan 40, manifold 42, and conduits 46. With the described arrangement the combustible waste material is substantially completely burned in suspension in a free vortex with the heavier solid waste fragments and non-combustible material traveling in a vortical path along the inner surface of the layer 34 and migrating toward the end wall 24. The solid material is forced toward the inner surface of the layer 34 by the tangential component of velocity of the vortex whereas the radially inward component of velocity creates high relative velocity between the air and burning material which greatly accelerates the combustion rate.

Additionally, in the described arrangement, the tangential injection of the secondary air through the openings 44 and at spaced points along the length of the chamber has the beneficial effect of periodically contributing to the vortex energy in the chamber. Thus, compensation is provided for losses in vortex energy or for effectively sustaining the vortex as the waste material progresses vertically along the length of the chamber.

The periodic or spaced tangential injection of secondary air and the resultant sustenance of the vortex along the entire length of the chamber enhance the efficiency of the waste burning process. Also, it reduces any tendency of combustion material particles, such as fly ash, to drop out of the vortex and settle on the bottom of the chamber which, if permitted to occur, can present substantial difficulties in effecting removal of such particles from the chamber and can require longer shut down times for chamber cleaning purposes. Also, it can adversely affect exhaust emissions.

For the purpose of predeterminedly controlling the secondary air generally and individually at each of the particular regions of injection into the chamber, adjustable control means are provided between the blower 40 and the manifold 42 and in each of the conduits 46 extending between the manifold and the chamber. More specifically, a damper comprising, for example a butterfly valve 48 is provided in the manifold 42 between the fan and the main portion of the manifold to which the several conduits 46 are connected. The operation of the butterfly valve 48 is determined by the operation of a suitable proportional motor 50 adapted for positioning the valve between open and closed positions in accordance with the degree of energization of the motor. The motor energization is, in turn, determined by a suitable control means generally indicated and designated 52 in FIG. 3. The control means 52 is operatively connected to a thermocouple or other suitable thermally responsive device 54 which extends into the chamber 22 to sense the temperature therein and provide an appropriate control signal. Specifically the control means 52 is adapted for automatically operating the damper or valve 48 in response to temperature variations within the chamber and such that the valve is moved toward its most open position in response to increases in temperature thereby to increase the flow of secondary air into the system, and toward its closed position in response to decreases in temperature thereby to decrease the flow of air into the system. The control means 52 is adjustably presettable so that the temperature range over which the valve automatically opens and closes is predeterminable by the operator, and is operatively connected to programmable controller panel 101 for additional operational controls.

The secondary air entering the chamber 22 through the openings 44 is further and individually controllable by means of separate and independently adjustable dampers 56 interposed one in each of the conduits 46. Each damper 56 is adapted for further controlling the secondary air as it enters the chamber at its respective region along the vortical path of the waste material. Thus, the dampers 56 are effective for enabling the operator to control separately and individually the energy added to the vortex at each of the regions, permitting more or less energy to be introduced as required to maintain a desired vortical profile and in accordance with experience as to regions where more or less energy is needed to compensate for energy losses in the vortex.

The total pressure of the air entering the chamber 22 through the openings 44 can be as high as 20 inches $H_2O$ and is preferably about 12 inches $H_2O$. However, such pressure can be as low as 4 inches $H_2O$ when burning finely divided, highly combustible material at a lower heat release rate. Therefore, pressures of air entering the chamber 22 through the openings 44 are generally within the range of 4 inches $H_2O$ to 20 inches $H_2O$.

Figure 7:
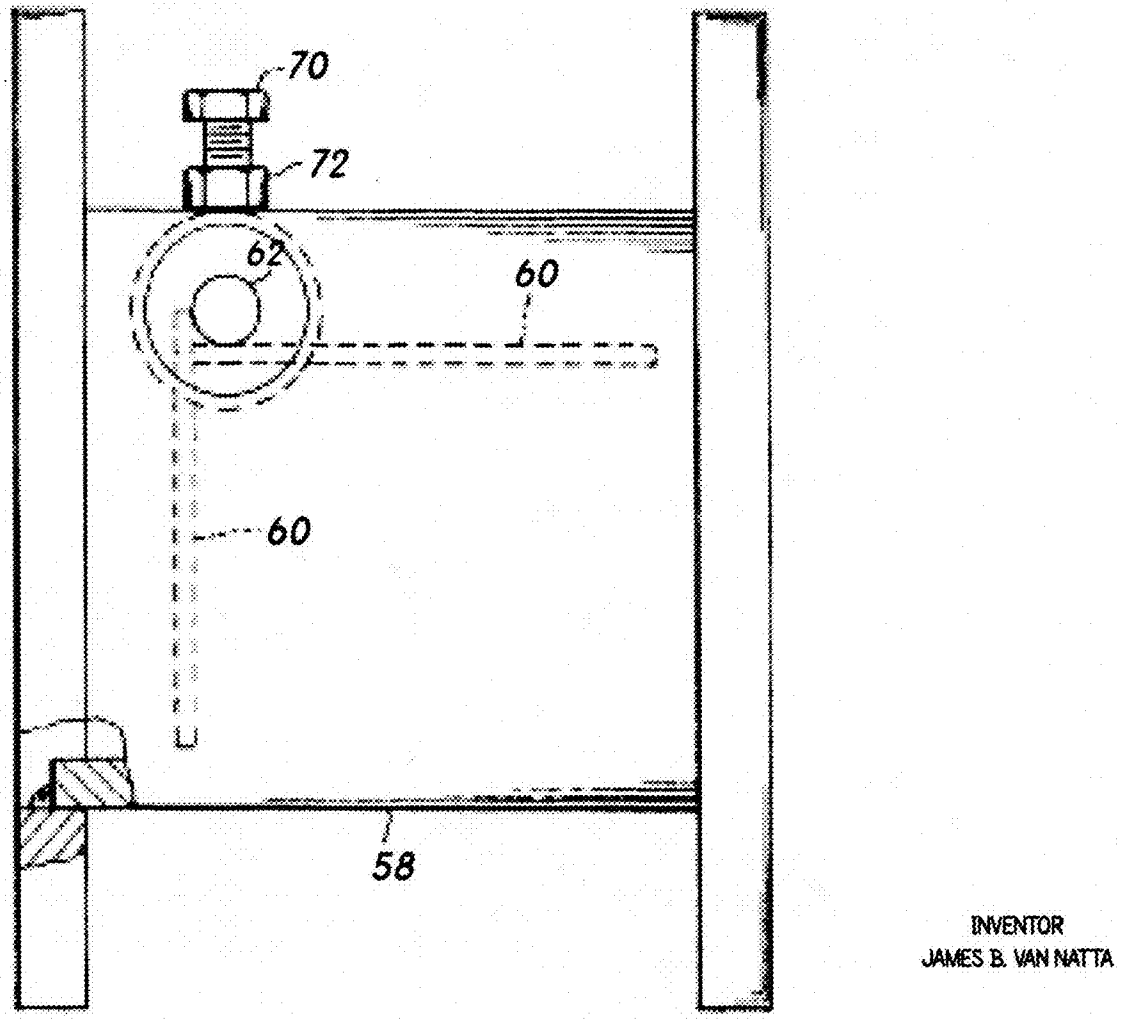
FIG. 7 is a view in side elevation of a damper mechanism associated with the manifold.
Figure 8:
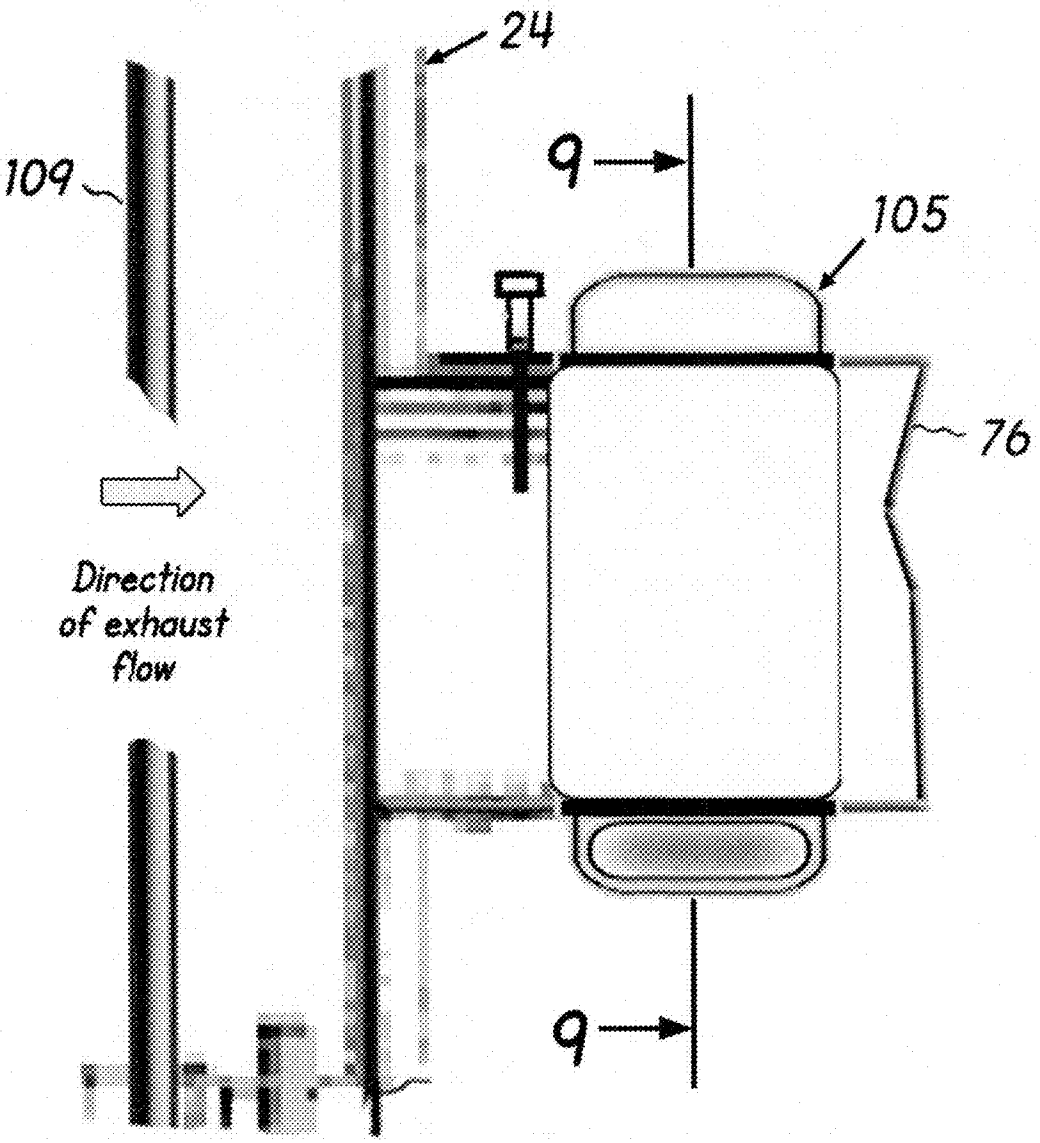
FIG. 8 is a view in side elevation of the recuperator attached to the external flue pipe as seen in FIG. 5.

The construction of the dampers 56 is best seen in FIGS. 6 and 7, and each such damper comprises a housing 58 of generally rectangular cross section and having suitable flanges for mounting in the respective conduits 46. Also, each damper includes an appropriate flapper element 60 which is pivotally movable about one end thereof between fully open horizontal and fully closed vertical positions illustrated in dash lines in FIG. 7. The pivoting of the element 60 is specifically accomplished by mounting it on a rod 62 suitably rotatably mounted between the side walls of the housing 58. A set screw 70 is threadedly mounted in the collar and carrying a lock nut 72. This arrangement permits the operator of the system to presettably position and lock each of the flapper elements 60 in a desired adjusted position in its respective damper housing for thereby controlling the air entering the chamber at its respective region and for the purpose discussed above. This arrangement is particularly adapted for manual individual adjustment of the dampers 56. However, it will be seen from the foregoing that, if desired, each of the dampers 56 could be controlled automatically in a manner similar to the butterfly valve and also that the dampers 56 could be automatically controlled individually or in a cooperating coordinated manner in response to various predetermined parameters such as, for example, secondary air temperature or temperature at different regions in the chamber, and networked with the programmable controller panel 101.

In order to discharge gaseous products of combustion from the chamber 22 to atmosphere first discharge means is provided including a first discharge port or flue 74 having an open end opening in the chamber in the region of the end wall 24 and substantially concentric with the central longitudinal axis of the chamber 22. As best shown in FIG. 3 the flue 74 includes a hollow cylinder or flue pipe 76 of any suitable material to resist extremely high temperatures and impact, extending through and suitably mounted in an opening in the end wall 24. In the particular embodiment of the invention shown, the end wall 24 includes adjacent layers 78 and 79 of high density refractory material and insulating firebrick, and a layer 80 with very good insulating properties, and an outer annular plate 82 secured together by suitable fasteners (not shown). The end wall 26 of the chamber 22 may be similarly formed. The cylinder 76 is releasably attached to a flue section (not shown) which terminates in an open end opening to atmosphere.

Second discharge means is provided for discharging from the chamber 22 during the burning process of non-combustible material. For this purpose, the preferred embodiment provides a second discharge port 84 having an open end 85 opening in the chamber 22 at a region downstream from the point of introduction of the waste material in the region adjacent the inner surface of the end wall 24 and adjacent the inner surface of the layer 34 for receiving and discharging from the chamber non-combustible material which is entrained in the outer region of the vortex. In the illustrated embodiment the port 84 comprises a conduit 86 extending through the side wall 28 substantially tangentially thereto and substantially horizontally at the bottom of the chamber as viewed in FIGS. 2 and 3 with its open end 85 opening at the inner surface of the layer 34. The conduit 86 leads to suitable separator and disposal means described hereinafter. With the described arrangement, the opening 85 is in the path of the non-combustible material which during operation of the combustor is at the outer region of the vortex and which has migrated to adjacent the end wall 24, and the action of the vortex causes such material to enter the opening 85 for discharge from the chamber 22. As shown in FIGS. 2 and 3 the conduit 86 extends horizontally adjacent the bottom of the chamber. Also, and as seen from FIG. 1, the discharge opening 85 provided by the conduit 86 is located substantially opposite and in substantially the same horizontal plane as one of the secondary air openings 44. This relative positioning of the second discharge port 85 and one of the secondary air openings 44 results in the injected secondary air from that opening being effective in assisting in the direction of fly ash and other waste materials through the second discharge port 85. To further facilitate the path of the non-combustible materials, a gutter 110 is cut into the bottom of the chamber along the previously described horizontal plane from the discharge opening 85 and the secondary air opening 44. (FIG. 4) This gutter 110 is located substantially adjacent the end wall 24, and extended from a position in front of one of the air openings 44 and the secondary discharge opening 85. Also it serves effectively to prevent waste material from accumulating in front of, and obstructing passage through, the discharge port 85. It is to be understood that although a single conduit 86 is illustrated, a plurality of such conduits can be provided if desired. Moreover, the conduit 86 can be replaced by a scoop positioned to receive material in the outer region of the vortex and connected to a conduit extending through the chamber wall. Also, each such conduit or scoop can be arranged to cooperate with an oppositely disposed secondary air inlet to obtain the resultant benefits described above.

The present invention further provides a separator 96 which is effective for separating the non-combustible materials discharged through the conduit 86 and for dropping this solid material into a suitable container 98. Gases and some combustible material in the form of ash will be introduced into the separator 96 as byproducts of the separation process. The separator 96 is preferably a commercially available cyclone or vortex type separator wherein material discharged through the conduit 86 is introduced tangentially into the separator 96 with the result that the solid material drops out the open end of the separator into the container 98. Such solid material constitutes ashes and other particulate matter formed in the combustion process and also non-combustible material which can be disposed of in any suitable manner.

In accord with the invention, the hot gases separated out by the separator 96 are introduced back into the chamber 22. This is very advantageous in that it maintains the vortex within the chamber 22, further cleans such gases by removing residual fly ash, and dries out wet waste material within the chamber 22. For this purpose a conduit 99 extends coaxially into the separator 96 at the top thereof so that the hot gases separated by the action of the separator 96 are drawn into the conduit 99 through the central low-pressure area and are conveyed through the conduit 99 to a fan 95 to withdraw the separated hot gases from the conduit 99 and to introduce such into the chamber 22. These gases are preferably introduced into the chamber 22 at an area downstream from the area of introduction of the secondary air. However, under certain conditions the secondary air fan 40 and the manifold 42 may be employed instead of the fan 95 to introduce the separated gases back into the chamber 22.

The total pressure available from the primary and secondary air entering the chamber is utilized to introduce energy into the vortex for obtaining high combustion rates and also to accelerate material out through the conduit 86 and the flue pipe 76. It has been observed that if the area of the orifice 71, which constitutes the open end of the discharge fluc port, is too small relative to an optimum area, then the combustion rates will be lower than optimum because too much of the available pressure will be used to accelerate the flow of material out of the combustion chamber. On the other hand, if the area of the open end of the discharge flue port is too large relative to the optimum area, it is impossible to establish the vortex flow field required for effecting centrifugal separation of the fly ash and for obtaining substantially complete combustion of larger particles. Tests have demonstrated that the optimum area of the open end of the discharge flue port bears a specific relationship to the area of the cross-section of the combustion chamber 22 taken perpendicular to its longitudinal axis.

Most if not all of any non-combustible material will enter the conduit 86 as it initially reaches the end wall 24. However, in the event that such material does not enter the conduit 86 when it initially reaches the end wall 24, this material becomes entrained in the stream of hot gases which normally flows in the direction of the arrows 88 along the inner surface of the end wall 24 toward the open end 90 of the flue pipe 76 where a low pressure area exists. If the open end of the flue pipe 76 were flush with the end wall, a considerable portion of this material would enter the flue pipe 76 thus necessitating provision of flue gas cleaning apparatus to avoid pollution of the surrounding atmosphere. In order to reduce the amount of such solid material which exits from the chamber 22 through the flue pipe 76, the flue pipe 76 is extended into the chamber 22 so that the inner open end of the flue pipe 76 is spaced axially inwardly from the end wall 24 as shown in FIG. 3. With this arrangement, the solid material which does not enter the conduit 86 tends to move from adjacent the end wall 24 along the diameter of the flue pipe 76 toward its open inner end. Such movement increases the time of residence of the material in the chamber 22 thus resulting in more complete combustion and a reduction in the amount of this material which enters the flue pipe if its open end were flush with the end wall 24.

Figure 4:
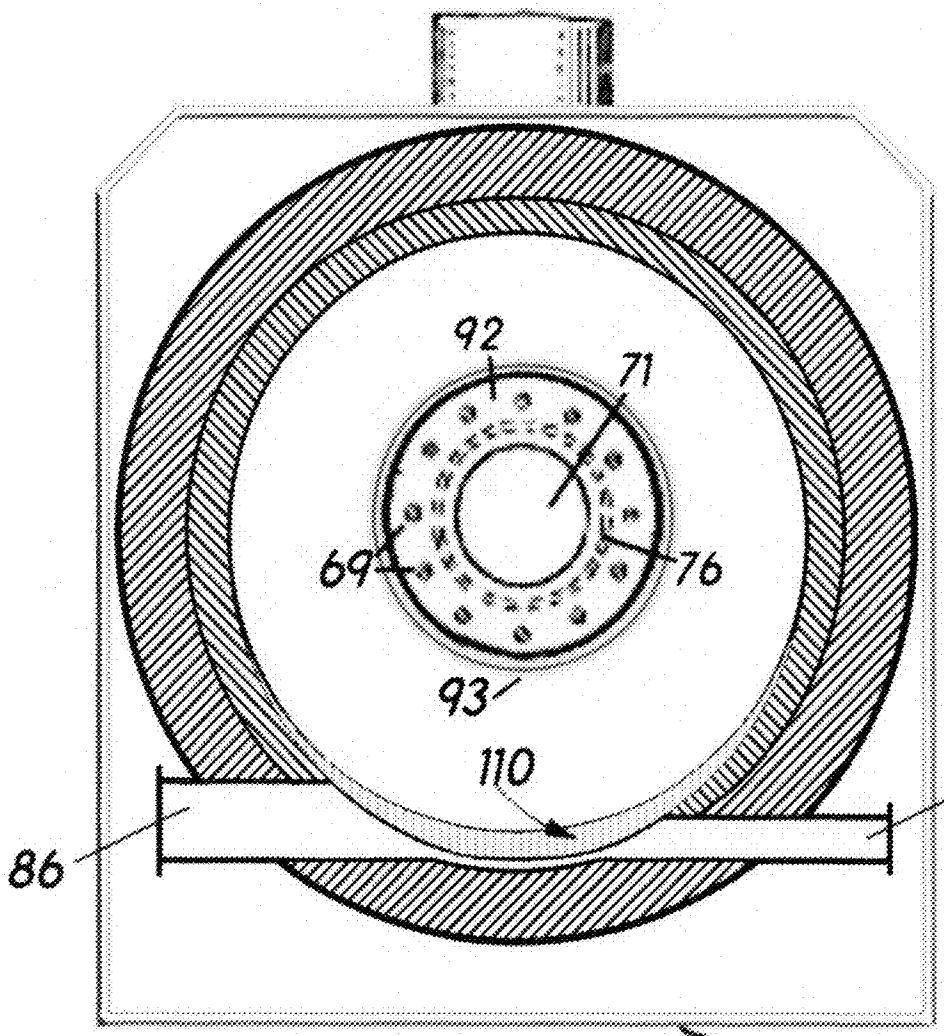
FIG. 4 is a view in section taken along the line 4-4 of FIG. showing baffle mechanism and bottom gutter.

In order to still further reduce the amount of solid material entering the flue pipe 76, a baffle 92 is positioned adjacent the open inner end of the flue pipe 76 to divert outwardly toward the inner layer 34 of the chamber 22 any residual solid combustible particulates and non-combustible material which moves from adjacent the end wall 24 toward the open end of the flue pipe 76. The arrangement is such that solid material moving in the direction of the arrows 88 engages the baffle 92 and is thereby deflected in the direction of the arrow 94 so that the material so diverted once again becomes entrained in the vortex for further burning and movement toward the end wall 24 for discharge through the conduit 86. As shown in FIGS. 3 and 4, the baffle 92 preferably comprises a plate of any suitable material in the form of a ring suitably releasably attached as by bolts 69 to another ring-shaped plate (not shown) which is welded or otherwise secured to the pipe 76 adjacent its open end. Additionally, there is a ring 93 mounted on the periphery of the main plate of the baffle, that is suitably releasably attached as by bolts (not shown), and creates an angle or beveled edge tilted in the direction of the front end wall, towards the oncoming vortex and waste materials. The width of the beveled ring 93 and the angle thereto are established by the material being consumed in the combustion process. The ring 93 serves to increase the residence time of the burning waste material, and enhances the deflection of residual combustible material towards the outer region of the vortex. The baffle 92 preferably overlies the open end of the flue pipe 76 and includes a central circular orifice 71 having a diameter d (FIG. 3) which is less than the inner diameter of the flue pipe 76. The orifice 71 of the baffle 92 thus constitutes the open end of the discharge flue port. The outside diameter of the baffle 92 and the diameter d of its orifice 71 are selected to provide the optimum performance for the conditions involved. Under certain conditions the baffle 92 may surround the pipe 76 adjacent its open end in which event the open end of the pipe 76 constitutes the open end of the discharge flue port.

The detachable mounting of the flue 74 to the end wall 26 as previously described permits detachment of the flue pipe 76 and the baffle 92 from the chamber 22 so as to permit replacement or repair of pipe 76 and baffle 92 as desired. Additionally, this arrangement disposes the inner end of the flue pipe 76 and the baffle 92 adjacent the region of the vortex which can be influenced by the secondary air injected through the opening disposed for cooperation with the discharge port 85. This arrangement together with the adjustability of the secondary air provided by the respective damper 56 affords the operator the opportunity to adjust the secondary air injected at this region in a manner to predeterminedly influence the energy condition of the vortex in the region of the flue pipe opening. Thus, one can adjust to a degree the pressure conditions in the region of the baffle 92 for thereby influencing the flow paths indicated by the arrows 88 and 94.

In accord with the present invention, the ratio of the area of the open end of the discharge flue port to the area of a cross-section of the combustion chamber taken perpendicular to its longitudinal axis is selected to be within the range of $1/16$ to $4/25$ and is preferably about $1/6$. In the illustrated embodiment of the invention these area ratios can be translated to corresponding diameter ratios with the result that the ratio of the diameter d of the open end of the circular discharge flue port to the diameter D of the cylindrical chamber 22 is selected to be within the range of $1/4$ to $2/5$. This range of diameter ratios has been found to be effective over a range of diameters of the chamber from 1½ feet to 15 feet.

In the preferred embodiment of the invention the ratio of the diameter d and the diameter D is selected to be approximately $1/3$ or in other words, the inner diameter D of the chamber 22 is selected to be about three times as great as the diameter d of the open end of the discharge flue port. It is understood of course that the invention is not limited to the particular cylindrical chamber configuration and circular discharge flue configuration illustrated and is applicable in its broader aspects to other configurations of the chamber and discharge flue which are non-cylindrical and non-circular.

The nature of the free vortex flow field is influenced strongly by the ratio of the diameter d to the diameter D. With proper dimensions of these diameters selected in accord with the invention, the strong free vortex flow field provides an increasing tangential velocity with decreasing radius. Thus the tendency of the particles to be drawn to the center of the chamber 22 by the drag forces imparted from the radially inward flow is counterbalanced by a stronger centrifugal force field. Therefore, the particles are maintained in suspension until complete combustion has occurred or until they are withdrawn from the chamber 22 through the conduit 86.

Figure 9:
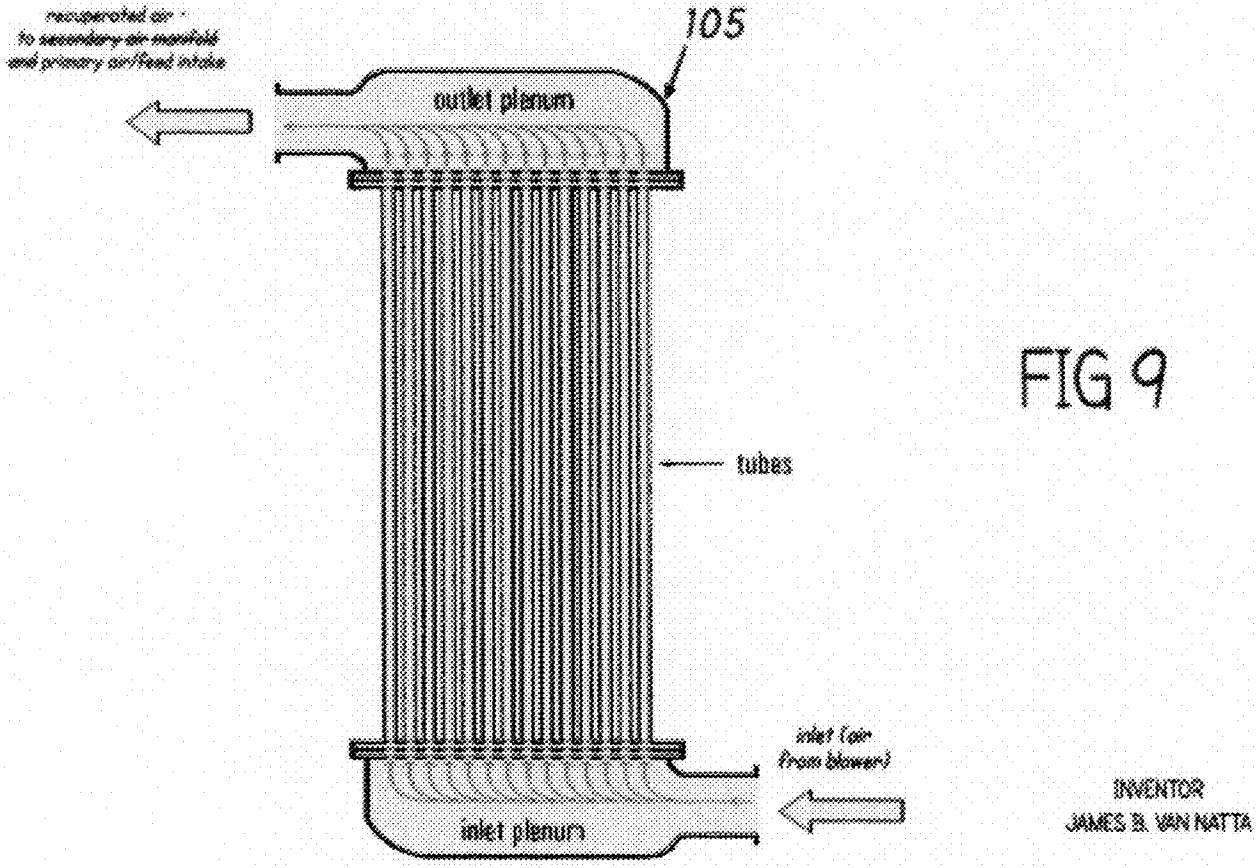
FIG. 9 is a view in section taken along the line 9-9 of FIG. 8.

The present invention further provides a means of recycling the heat produced by the combustion process inside of the chamber 22, by use of a recuperator 105 (FIG. 8) installed in the exterior section of the exhaust flue 76. Air from the blower unit 40 is injected into the inlet plenum of the recuperator 105 through the use of a pipe 112 (FIG. 1) and exits through the use of a pipe 111. As seen in FIG. 9, a series of tubes extend from the inlet plenum to the outlet plenum, where two portals (not shown) transfer the heated or recuperated air to the primary air and waste feed intake section pipe 20.

The present invention further provides for a control means to integrate the various components for purposes of operational control, such as the size-reduction unit 10 and primary air blower 16, the burner 38, secondary air control 52 and motor 50, a number of chamber atmospheric sensors 100, and flue emissions sensors 102. The control means 101 consists of any combination of commercially available devices, such as a computer, programmable automation controller, programmable logic controller, or similar industrial control system, along with the necessary wired and/or wireless interface materials and equipment. Readings from one or any combination of the atmospheric sensors can be used to cause adjustments with the burner and/or secondary air, using predetermined values. The recuperator 105 is similarly integrated into the control panel 101 to allow control and management of the air flow back to the secondary air manifold 42 and the feed and primary air intake 20.

The chamber atmospheric sensors 100 measure, record, and transmit data related to conditions such as chamber temperature, vortex air speed, moisture content, BTU heat value of material being consumed, pressure, and capacity. The sensors 100 are connected to a control panel 101 that operates in combination with other network equipment as indicated previously, or separately to transmit data and signals to the various components to adjust the operation or functionality of each. For example, the size reduction unit 10 and primary air blower 16 can be connected to control panel 101 to automatically control each, in accordance with the overall system operation, including automatic safety shut-off capability.

The burner 38 is additionally controlled by the control panel 101 by use of a chamber atmospheric temperature sensor 100 transmitting temperature readings within the chamber, and allowing the burner 38 to be turned off following proper ignition of the shredded waste material, or to be turned on to increase the temperature of the mixture of the waste material and primary air, by energizing the burner 38 as with the initial ignition of waste entering the chamber 22.

Control means are further provided for the secondary air process, with the use of an atmospheric sensor 100, through the interfacing of the control panel 101 and the secondary air control 52 and motor 50. Using predetermined criteria, the control panel 101 is capable of adjusting the flow of secondary air into the chamber 22, by operationally controlling the secondary air blower 40, manifold 42, butterfly valves 48, and dampers 56. It has been observed that the control of the burner 38 together with the secondary air blower 40, manifold 42, butterfly valves 48, and dampers 56, can be adjusted in combination to more efficiently control the chamber temperature, moisture content, and vortex speed.

The flue emissions sensor 102 provides for monitoring and data retrieval of all flue emissions and conditions. Although not related to the operations of the combustion system and process, the flue emissions sensor 102 is connected to the control panel 101, and to a computer system with commercially available software for collection, reporting, and transmitting of environmental data in accordance with current United States Environmental Protection Agency's air quality and emissions standards, as well as those for state and local agencies. The control panel 101 and/or any interconnected computer equipment is/are capable of being connected directly or indirectly and can communicate over popular network interface protocols such as TCP/IP, OLE for process control (OPC), and SMTP. This network interfacing will allow for real-time data transmission, as well as remote access of the various operational controls.

By means of the invention a very efficient combustor is provided characterized by the exhaust of gases to the atmosphere which are substantially free of particulate matter so as to minimize air and water pollution. In addition, non-combustible material is discharged from the combustion chamber during the burning process by action of the vortex so as to avoid the provision of costly and complex material handling apparatus for conveying such material away from the combustion chamber. Further, the provision of costly and complex flue gas cleaning apparatus is avoided by the invention which allows operation of the combustor at temperatures which are higher than that which would be allowable in the event flue gas cleaning apparatus were utilized. Moreover, the combustor effects substantially complete combustion of combustible waste material resulting in an extremely high percentage reduction in the original volume of waste material.

A typical design of the combustor of the present invention includes a combustion chamber having an internal length of 5.5 feet and an inner diameter D of 4 feet. The flue pipe 76 has an inner diameter of 18 inches and extends into the chamber a distance of about 18 inches from the inner surface of the end wall 24. The baffle plate 92 has a diameter of approximately 24 inches and its orifice 71 has a diameter d of about 16 inches. Also, the conduit 86 has an inner diameter of between 4 and 6 inches.

A combustor of such design presently appears capable of disposing of solid waste having up to 49% moisture content and normally 40% ash content and a sufficient BTU rating based on the waste material introduced, to effect more than 99 percent destruction of combustible material. It presently appears that such a combustor design emits particulate matter to the atmosphere of not more than 0.2 grains per standard dry cubic foot of flue gas. The forgoing results seem to be obtainable with chamber temperatures between 1,800° F. and 2,200° F.

Although the invention has been described with reference to certain specific embodiments thereof, numerous modifications are possible, and it is desired to cover all modifications falling within the spirit and scope of the invention.

What I claim as new and desire to secure by Letters Patent of the United States is:

1. A combustor for burning shredded waste material, the combustor comprising:

a first blower configured to entrain the shredded waste material in a primary air stream;

a generally cylindrical combustion chamber comprising spaced first and second end walls, an annular side wall and a central longitudinal axis extending between said first and second end walls, wherein the central longitudinal axis is oriented substantially horizontally, wherein said generally cylindrical combustion chamber defines a first opening in the annular side wall, a second opening in the second end wall and a plurality of third openings in the annular side wall, and wherein said plurality of third openings are spaced apart from said first and second end walls;

a first conduit extending between said first blower and said first opening in the generally cylindrical combustion chamber, wherein said first conduit and said first opening are configured to introduce said primary air stream into said generally cylindrical combustion chamber tangentially to said annular side wall to establish a vortical movement of said waste material between said first and second side walls;

a discharge flue extending through said second opening in said second end wall, wherein said discharge flue is substantially concentric with said central longitudinal axis and wherein an internal end of said discharge flue is spaced axially from said second end wall;

a discharge port with an open end in said combustion chamber adjacent the inner surface of said annular side wall, wherein said discharge port is substantially tangential to said annular side wall near the bottom of said combustion chamber;

a second blower configured to produce a secondary air stream;

a second conduit extending between said second blower and the plurality of third openings in the annular side wall, wherein said second conduit and said plurality of third openings are configured to maintain the vortical movement of said waste material between said first and second side walls, wherein a fourth opening is positioned substantially opposite from the discharge port, wherein the annular side wall of the combustion chamber defines a gutter cut into a bottom surface of the annular side wall of the chamber along a horizontal line extending between said discharge port and the fourth opening, wherein the horizontal line is perpendicular to the central longitudinal axis, and wherein the second conduit extends between said second blower and the fourth opening;

a plurality of first dampers configured to vary the flow of the secondary air stream through each of the plurality of third openings;

a temperature sensor configured to determine a temperature within said combustion chamber; and a first controller configured to adjust the plurality of first dampers in response to variations of the temperature determined by the temperature sensor.

2. The combustor of claim 1 further comprising a recuperator that receives heated air from the discharge flue and heats a third air stream that is mixed with the primary air stream thereby reducing a moisture content of the shredded waste material before the shredded waste material enters the combustion chamber.

3. The combustor of claim 1, further comprising a baffle on said internal end of said discharge flue, wherein said baffle extends both radially away from said discharge flue and longitudinally away from said second end wall.

4. The combustor of claim 1, wherein said plurality of third openings are spaced equally along a longitudinally length of said annular side wall.

5. The combustor of claim 1, further comprising a size reduction unit configured to produce the shredded waste material from waste materials.

6. The combustor of claim 1, further comprising an ignitor configured to ignite the shredded waste material in the combustion chamber.

7. A combustor for burning shredded waste material, the combustor comprising:

a first blower configured to entrain the shredded waste material in a primary air stream;

a generally cylindrical combustion chamber comprising spaced first and second end walls, an annular side wall and a central longitudinal axis extending between said first and second end walls, wherein the central longitudinal axis is oriented substantially horizontally, wherein said generally cylindrical combustion chamber defines a first opening in the annular side wall, a second opening in the second end wall and a plurality of third openings in the annular side wall, and wherein said plurality of third openings are spaced apart from said first and second end walls;

a first conduit extending between said first blower and said first opening in the generally cylindrical combustion chamber, wherein said first conduit and said first opening are configured to introduce said primary air stream into said generally cylindrical combustion chamber tangentially to said annular side wall to establish a vortical movement of said waste material between said first and second side walls;

a discharge flue extending through said second opening in said second end wall, wherein said discharge flue is substantially concentric with said central longitudinal axis and wherein an internal end of said discharge flue is spaced axially from said second end wall;

a second blower configured to produce a secondary air stream;

a second conduit extending between said second blower and the plurality of third openings in the annular side wall, wherein said second conduit and said plurality of third openings are configured to maintain the vortical movement of said waste material between said first and second side walls;

a discharge port with an open end in said combustion chamber adjacent the inner surface of said annular side wall, wherein said discharge port is substantially tangential to said annular side wall near the bottom of said combustion chamber, wherein one of said plurality of third openings is positioned in said annular side wall substantially opposite said discharge port;

a gutter cut into a bottom surface of the annular side wall of the chamber along a horizontal line extending between said discharge port and said one of said plurality of third openings opposite said discharge port, wherein the horizontal line is perpendicular to the central longitudinal axis, and wherein said gutter is defined in an internal bottom surface of said annular side wall;

a plurality of first dampers configured to vary the flow of the secondary air stream through each of the plurality of third openings;

a temperature sensor configured to determine a temperature within said combustion chamber; and a first controller configured to adjust the plurality of first dampers in response to variations of the temperature determined by the temperature sensor.

8. The combustor of claim 7, further comprising a recuperator that receives heated air from the discharge flue and heats a third air stream that is mixed with the primary air stream thereby reducing a moisture content of the shredded waste material before the shredded waste material enters the combustion chamber.

9. The combustor of claim 7, further comprising a baffle on said internal end of said discharge flue, wherein said baffle extends both radially away from said discharge flue and longitudinally away from said second end wall.

10. The combustor of claim 7, wherein said plurality of third openings are spaced equally along a longitudinally length of said annular side wall.

11. The combustor of claim 7, further comprising a size reduction unit configured to produce the shredded waste material from waste materials.

12. The combustor of claim 7, further comprising an ignitor configured to ignite the shredded waste material in the combustion chamber.

13. The combustor of claim 1, wherein said generally cylindrical combustion chamber has an internal length of 5.5 feet and an inner diameter of 4 feet.

14. The combustor of claim 13, wherein there are exactly three third openings.

* * * * *